US010576334B2

(12) United States Patent
Wang

(10) Patent No.: US 10,576,334 B2
(45) Date of Patent: Mar. 3, 2020

(54) BALL STRUCTURE AND MANUFACTURING METHOD THEREOF

(71) Applicant: CHAEI HSIN ENTERPRISE CO., LTD., Taichung (TW)

(72) Inventor: Shui-Mu Wang, Taichung (TW)

(73) Assignee: CHAEI HSIN ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 16/024,922

(22) Filed: Jul. 2, 2018

(65) Prior Publication Data

US 2019/0336830 A1 Nov. 7, 2019

(30) Foreign Application Priority Data

May 3, 2018 (TW) ..... 107115096 A

(51) Int. Cl.
*A63B 41/08* (2006.01)
*A63B 45/00* (2006.01)

(52) U.S. Cl.
CPC ..... *A63B 41/08* (2013.01); *A63B 45/00* (2013.01); *A63B 2243/0037* (2013.01)

(58) Field of Classification Search
CPC .. A63B 41/08; A63B 45/00; A63B 2243/0037
See application file for complete search history.

(56) References Cited

U.S. PATENT DOCUMENTS 2,182,053 A * 12/1939 Reach ..... A63B 41/08 473/597
3,506,265 A * 4/1970 Yugi ..... A63B 41/00 473/125
4,034,495 A * 7/1977 Lemelson ..... B32B 27/00 40/453
5,286,020 A * 2/1994 Caruso ..... A63B 41/00 473/603
5,542,662 A * 8/1996 Kouzai ..... A63B 41/00 473/605
5,636,835 A * 6/1997 Schindler ..... A63B 41/08 473/605
5,681,233 A * 10/1997 Guenther ..... A63B 41/00 473/604
5,931,752 A * 8/1999 Guenther ..... A63B 41/08 473/597
6,022,283 A 2/2000 Schindler et al.
6,206,795 B1 * 3/2001 Ou ..... A63B 41/08 473/599
6,422,961 B1 * 7/2002 Feeney ..... A63B 41/08 473/596
6,506,135 B2 * 1/2003 Ou ..... A63B 41/08 156/172
6,520,877 B1 * 2/2003 Yang ..... A63B 41/08 473/597
2003/0008736 A1 * 1/2003 Hung ..... A63B 41/08 473/598

(Continued)

*Primary Examiner* — Steven B Wong
(74) *Attorney, Agent, or Firm* — Birch, Stewart, Kolasch & Birch, LLP

(57) ABSTRACT

A ball structure includes an inner layer, at least two cover panels and a cover strip. The two cover panels are disposed on the inner layer. A groove is formed among the two cover panels adjacent to each other and the inner layer. The cover strip is engaged in the groove and connected between the two cover panels adjacent to each other.

4 Claims, 11 Drawing Sheets

(56) References Cited

U.S. PATENT DOCUMENTS

| | | | | |
|---|---|---|---|---|
| 2003/0228946 | A1* | 12/2003 | Chan | A63B 41/00 473/604 |
| 2004/0121865 | A1* | 6/2004 | Lee | A63B 41/08 473/597 |
| 2005/0153803 | A1* | 7/2005 | Swiszcz | A63B 41/08 473/593 |
| 2007/0238562 | A1* | 10/2007 | Nagao | A63B 39/06 473/605 |
| 2008/0051234 | A1* | 2/2008 | Nagao | A63B 39/06 473/604 |
| 2012/0058845 | A1* | 3/2012 | Crowley | A63B 41/00 473/604 |
| 2013/0059683 | A1* | 3/2013 | Krysiak | A63B 41/02 473/597 |
| 2017/0120497 | A1* | 5/2017 | Lin | B29C 47/0045 |

* cited by examiner

BALL STRUCTURE AND MANUFACTURING METHOD THEREOF

RELATED APPLICATIONS

This application claims priority to Taiwan Application Serial Number 107115096 filed on May 3, 2018, which is herein incorporated by reference.

BACKGROUND

Technical Field

The present disclosure relates to a ball structure and a manufacturing method thereof. More particularly, the present disclosure relates to a ball structure and a manufacturing method thereof having a supporting effect and a continuous pattern on a surface of the ball structure.

Description of Related Art

Game balls for sports such as basketballs, footballs, soccer balls, volleyballs, rugby balls, baseballs and softballs are well known. Many game balls, such as basketballs, typically include an inner layer, a plurality of cover panels and a cover strip. The inner layer is inflatable. The cover panels are commonly made of rubber, leather, synthetic leather or a polymeric material. The cover strip is commonly made of a filler material or rubber.

In a ball structure, a conventional technique utilizes a material of the cover strip which is harder than a material of the cover panels. The cover strip is typically engaged with the inner layer and the cover panels of the basketball, and the cover strip can facilitate a player's ability to grasp, handle, shoot, pass, dribble and otherwise control the ball during play. However, a poor touch effect of different hardness surfaces easily reduces the controllability and playability of the ball so as to increase the probability of missing during play. Moreover, the cover strip has a single color, such as black, so that the panel patterns between two cover panels adjacent to each other may not be continuous because of the cover strip. Therefore, a ball structure and a manufacturing method thereof having a supporting effect, consistent uniformity of hardness and a continuous pattern on a surface of the ball structure are commercially desirable.

SUMMARY

According to one aspect of the present disclosure, a ball structure includes an inner layer, at least two cover panels and a cover strip. The two cover panels are disposed on the inner layer. A groove is formed among the two cover panels adjacent to each other and the inner layer. The cover strip is engaged in the groove and connected between the two cover panels adjacent to each other.

According to another aspect of the present disclosure, a ball structure includes an inner layer, at least two cover panels and a cover strip. The two cover panels are disposed on the inner layer. A groove is formed among the two cover panels adjacent to each other and the inner layer. The cover strip is engaged in the groove. The cover strip includes a first layer and a second layer. The first layer is connected to the second layer. A hardness of the first layer is different from a hardness of the second layer, and the first layer is connected between the two cover panels adjacent to each other.

According to further another aspect of the present disclosure, a manufacturing method of a ball structure provides a cover panel forming step and a cover strip engaging step. The cover panel forming step is for affixing at least two cover panels on an inner layer to form a groove among the two cover panels adjacent to each other and the inner layer. The cover strip engaging step is for injecting a gas into the ball structure to expand the inner layer so as to increase a width of the groove, engaging a cover strip in the groove, and then discharging the gas from the ball structure to shrink the inner layer so as to decrease the width of the groove and tightly connect the cover strip to the two cover panels.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
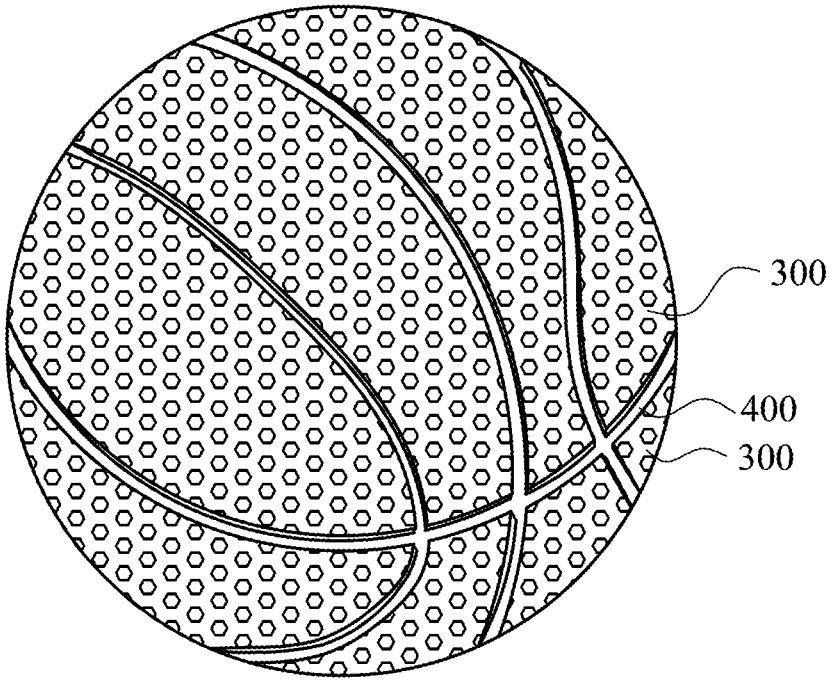
FIG. 1 shows a schematic view of a ball structure according to a first embodiment of the present disclosure.
Figure 2:
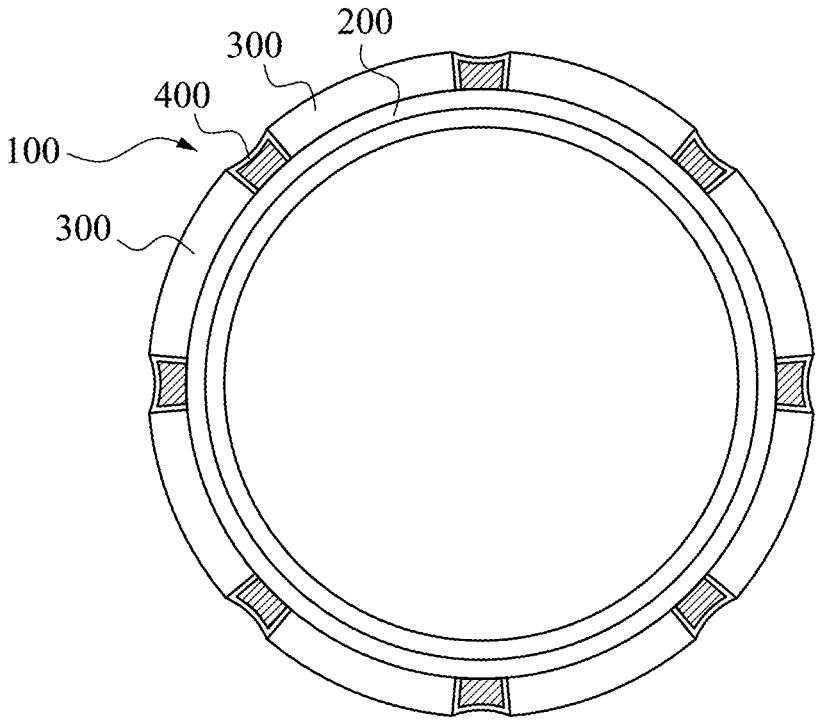
FIG. 2 shows a cross-sectional view of the ball structure of FIG. 1.
Figure 3A:
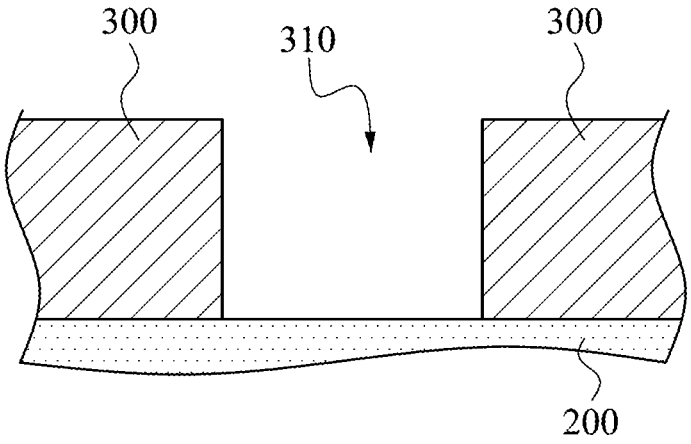
FIG. 3A shows a schematic view of a groove formed among two cover panels adjacent to each other and an inner layer of FIG. 2.
Figure 3B:
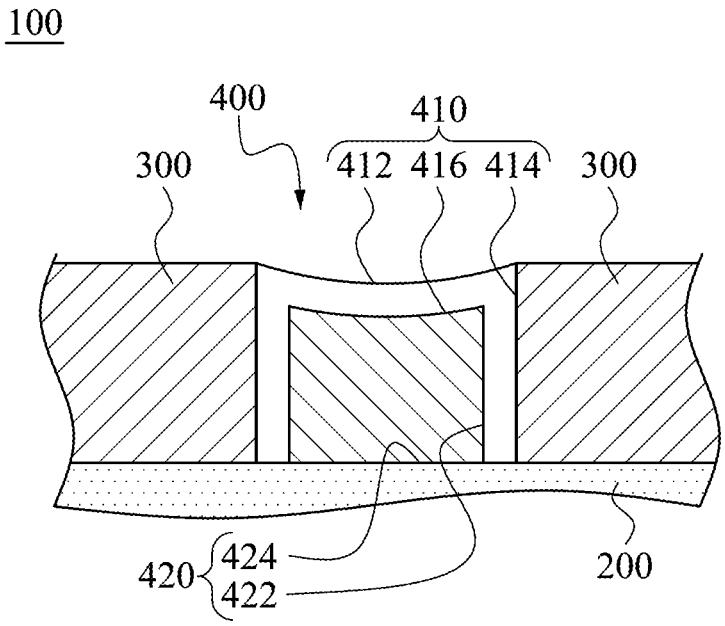
FIG. 3B shows a schematic view of the inner layer, the two cover panels and a cover strip of FIG. 2.

FIG. 1 shows a schematic view of a ball structure 100 according to a first embodiment of the present disclosure; FIG. 2 shows a cross-sectional view of the ball structure 100 of FIG. 1; FIG. 3A shows a schematic view of a groove 310 formed among two cover panels 300 adjacent to each other and an inner layer 200 of FIG. 2; and FIG. 3B shows a schematic view of the inner layer 200, the two cover panels 300 and a cover strip 400 of FIG. 2. In FIGS. 1, 2, 3A and 3B, the ball structure 100 may be a basketball and includes the inner layer 200, a plurality of cover panels 300 and a cover strip 400.

The cover panels 300 are disposed on the inner layer 200. A groove 310 is formed among every two of the cover panels 300 adjacent to each other and the inner layer 200. The cover panels 300 are made of a soft elastic material. In the embodiment of FIG. 1, the ball structure 100 is a basketball. Each of the cover panels 300 has a rugged surface.

The cover strip 400 is engaged in the groove 310. The cover strip 400 includes a first layer 410 and a second layer 420. The first layer 410 is connected to the second layer 420 and is supported by the second layer 420. A hardness of the first layer 410 is smaller than a hardness of the second layer 420 (i.e., a hard inner layer and a soft outer layer), and the first layer 410 is connected between the two cover panels 300 adjacent to each other. In detail, the first layer 410 includes a first outer surface 412, two side surfaces 414 and a first inner surface 416. The first outer surface 412 is arc-shaped and faces outwardly. The two side surfaces 414 are connected to the two cover panels 300 adjacent to each other, respectively. The first inner surface 416 is connected to the second layer 420 and opposite to the first outer surface 412. The second layer 420 includes a second outer surface 422 and a second inner surface 424. The second outer surface 422 is connected to the first inner surface 416. The second inner surface 424 is connected to the inner layer 200 and the second outer surface 422. Therefore, the ball structure 100 of the present disclosure utilizes the cover strip 400 having the soft first layer 410 and the hard second layer 420 to achieve a supporting effect.

In another embodiment, the hardness of the first layer 410 may be greater than the hardness of the second layer 420 (i.e., a soft inner layer and a hard outer layer). Accordingly, the ball structure 100 of the present disclosure utilizes the cover strip 400 having the hard first layer 410 and the soft second layer 420 to achieve the supporting effect.

Figure 4A:
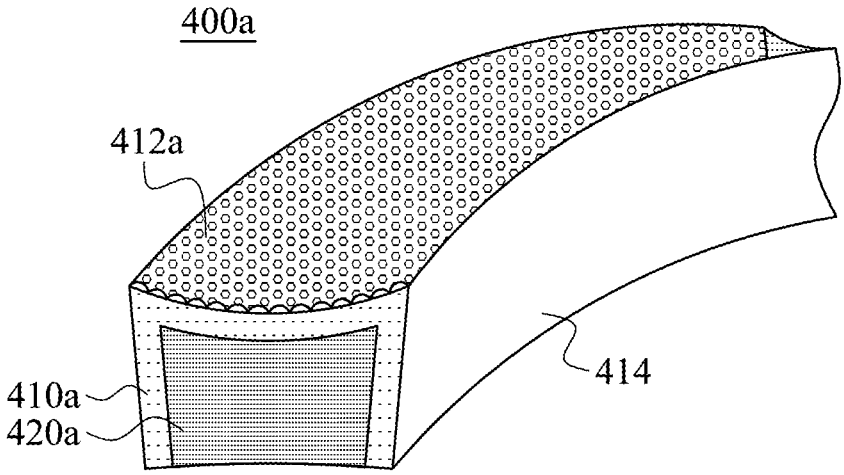
FIG. 4A shows a schematic view of a cover strip according to a second embodiment of the present disclosure.
Figure 4B:
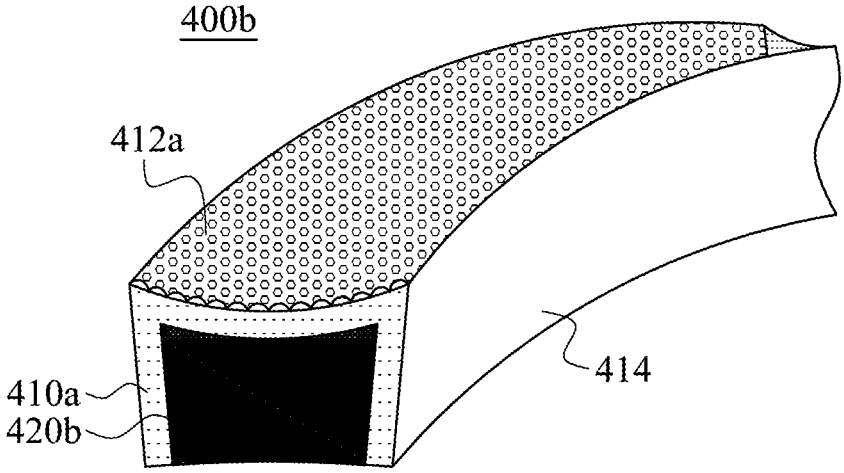
FIG. 4B shows a schematic view of a cover strip according to a third embodiment of the present disclosure.

FIG. 4A shows a schematic view of a cover strip 400*a* according to a second embodiment of the present disclosure; and FIG. 4B shows a schematic view of a cover strip 400*b* according to a third embodiment of the present disclosure. In FIG. 4A, the cover strip 400*a* includes a first layer 410*a* and a second layer 420*a*. The structure of the second layer 420*a* is the same as the structure of the second layer 420 of FIG. 3B and will not be described again herein. The first layer 410*a* includes a first outer surface 412*a* having a rugged shape and being arc-shaped. In FIG. 4A, the first layer 410*a* is made of the same material as the second layer 420*a*. A hardness of the first layer 410*a* is smaller than a hardness of the second layer 420*a*. In FIG. 4B, the cover strip 400*b* includes the first layer 410*a* and a second layer 420*b*. The structure of the second layer 420*b* is the same as the structure of the second layer 420 of FIG. 3B and will not be described again herein. The first layer 410*a* includes a first outer surface 412*a* having the rugged shape and the arc shape. In FIG. 4B, the first layer 410*a* is made of a material different from the second layer 420*b*. The first layer 410*a* and the second layer 420*b* are integrally injection molded. Therefore, the hardness of the first layer 410*a* is smaller than the hardness of the second layer 420*a*, 420*b* so as to achieve the supporting effect.

Figure 5:
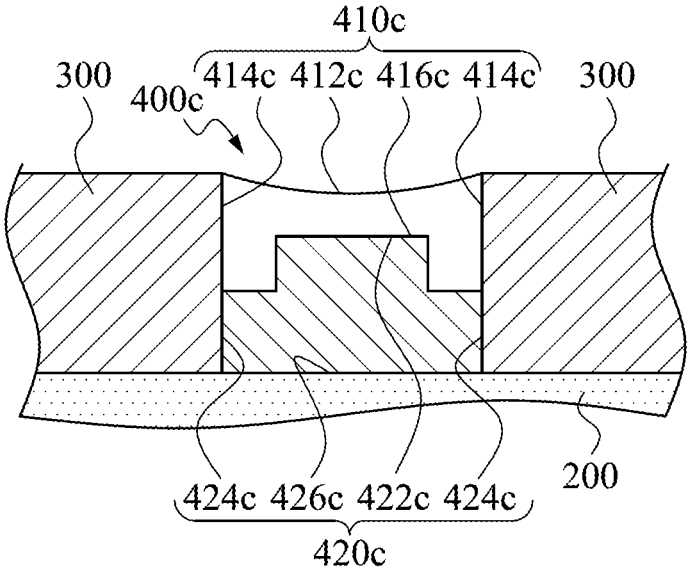
FIG. 5 shows a schematic view of an inner layer, two cover panels and a cover strip according to a fourth embodiment of the present disclosure.

FIG. 5 shows a schematic view of an inner layer 200, two cover panels 300 and a cover strip 400*c* according to a fourth embodiment of the present disclosure. In FIG. 5, the structures of the inner layer 200 and the two cover panels 300 are the same as the structures of the inner layer 200 and the two cover panels 300 of FIG. 3A. The cover strip 400*c* includes a first layer 410*c* and a second layer 420*c*. The first layer 410*c* has a concave shape. The first layer 410*c* includes a first outer surface 412*c*, two first side surfaces 414*c* and a first inner surface 416*c*. The first outer surface 412*c* is arc-shaped. The two first side surfaces 414*c* are connected to the two cover panels 300 adjacent to each other, respectively. The first inner surface 416*c* is correspondingly connected to the second layer 420*c*. Moreover, the second layer 420*c* has a convex shape and is corresponding to the first layer 410*c*. The second layer 420*c* includes a second outer surface 422*c*, two second side surfaces 424*c* and a second inner surface 426*c*. The second outer surface 422*c* is connected to the first inner surface 416*c*. The two second side surfaces 424*c* are connected to the two cover panels 300 adjacent to each other, respectively. The second inner surface 426*c* is connected to the inner layer 200. Therefore, the inner layer 200 combined with the two cover panels 300 and the cover strip 400*c* of the present disclosure can achieve the supporting effect.

Figure 6:
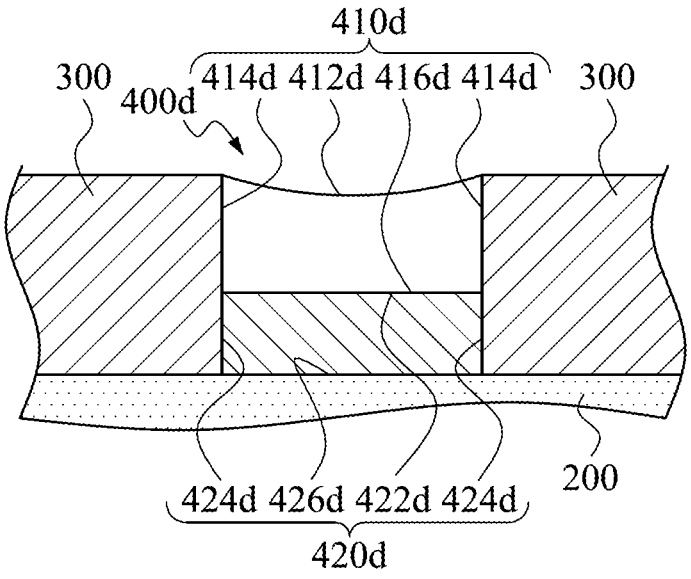
FIG. 6 shows a schematic view of an inner layer, two cover panels and a cover strip according to a fifth embodiment of the present disclosure.

FIG. 6 shows a schematic view of an inner layer 200, two cover panels 300 and a cover strip 400*d* according to a fifth embodiment of the present disclosure. In FIG. 6, the structures of the inner layer 200 and the two cover panels 300 are the same as the structures of the inner layer 200 and the two cover panels 300 of FIG. 5. A difference between the cover strip 400*c* of FIG. 5 and the cover strip 400*d* of FIG. 6 is that the second outer surface 422*c* of the cover strip 400*c* of FIG. 5 has a convex shape, and the second outer surface 422*d* of the cover strip 400*d* of FIG. 6 has a flat shape. Therefore, the cover strip 400*d* of the present disclosure is implemented by a stacked structure having different hardness so as to achieve the supporting effect. The hardness of the first layer 410*d* (i.e., the upper layer) may be close to the hardness of each of the two cover panels 300.

Figure 7:
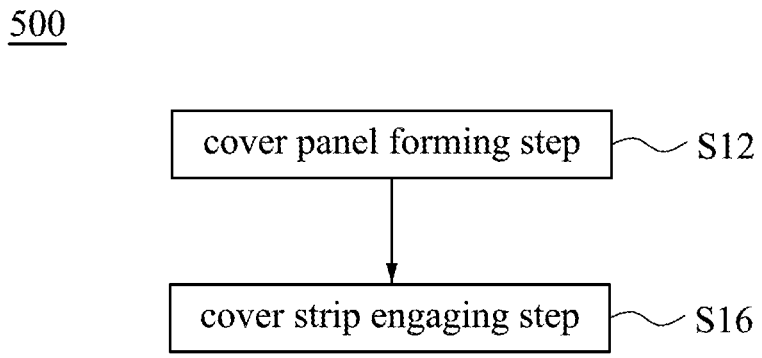
FIG. 7 shows a flow chart of a manufacturing method of a ball structure according to another embodiment of the present disclosure.

FIG. 7 shows a flow chart of a manufacturing method 500 of a ball structure 100 according to another embodiment of the present disclosure. The ball structure 100 is shown in FIG. 3B. The manufacturing method 500 of the ball structure 100 provides a cover panel forming step S12 and a cover strip engaging step S16. The cover panel forming step S12 is for affixing a plurality of cover panels 300 on an inner layer 200 to form a groove 310 among the inner layer 200 and every two of the cover panels 300 adjacent to each other. In the cover panel forming step S12, a grain, a pattern or a color of the cover panels 300 may be formed by using a digital printing method, a 3D printing method, an embossing method or a dyeing method. The cover strip engaging step S16 is for injecting a gas into the ball structure 100 to expand the inner layer 200 so as to increase a width of the groove 310, engaging a cover strip 400 in the groove 310, and then discharging the gas from the ball structure 100 to shrink the inner layer 200 so as to decrease the width of the groove 310 and tightly connect the cover strip 400 to the cover panels 300. Furthermore, the manufacturing method 500 of the present disclosure can not only produce the ball structure 100 of FIG. 3B, but also produce the ball structures of FIGS. 4A, 4B, 5 and 6. The structures of the cover strips 400, 400*a*, 400*b*, 400*c*, 400*d* are different from each other.

Figure 8:
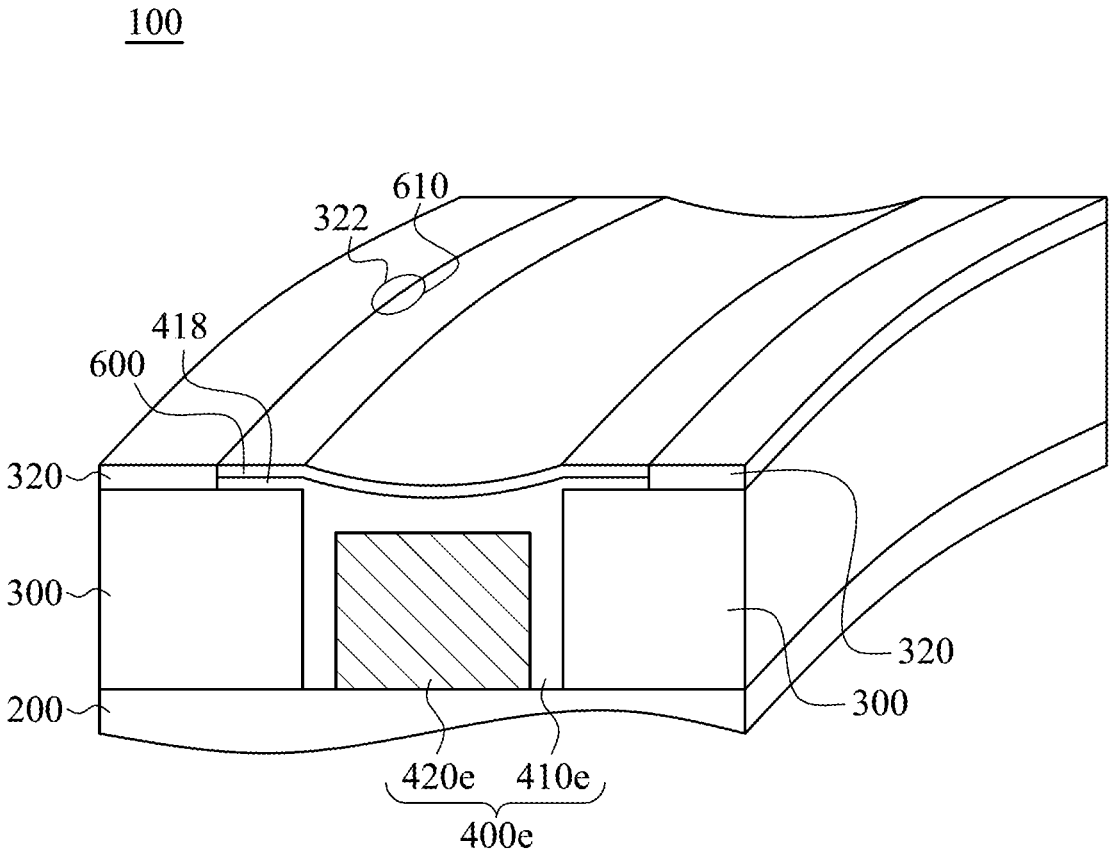
FIG. 8 shows a schematic view of a ball structure according to a sixth embodiment of the present disclosure.

FIG. 8 shows a schematic view of a ball structure 100 according to a sixth embodiment of the present disclosure. The ball structure 100 includes an inner layer 200, a plurality of cover panels 300, a plurality of panel film layer 320, a cover strip 400*e* and a strip film layer 600.

In FIG. 8, the structures of the inner layer 200 and the cover panels 300 are the same as the structures of the inner layer 200 and the cover panels 300 of FIG. 3A and will not be described again herein. The ball structure 100 further includes the panel film layer 320, the cover strip 400*e* and the strip film layer 600. The panel film layer 320 is adhered to an upper surface of the cover panels 300 and has a panel pattern 322. The cover strip 400*e* includes a first layer 410*e* and a second layer 420*e*. The first layer 410*e* is connected to the second layer 420*e*. A hardness of the first layer 410*e* is different from a hardness of the second layer 420*e*. The first layer 410*e* is connected between the two cover panels 300 adjacent to each other. The first layer 410*e* of the cover strip 400*e* includes two convex portions 418, and the two convex portions 418 are abutted against two surfaces of the two cover panels 300 adjacent to each other, respectively. The strip film layer 600 is adhered to the first layer 410*e* and has a strip pattern 610. The strip pattern 610 of the strip film layer 600 is communicated with the panel pattern 322 of the panel film layer 320. Hence, the strip pattern 610 of the strip film layer 600 is consistent with the panel pattern 322 of the panel film layer 320. After injecting a gas into the ball structure 100 to expand the inner layer 200, the cover strip 400*e* is thermally engaged in the groove 310 to form a continuous pattern on the cover strip 400*e* and each of the cover panels 300 so as to solve a problem of a discontinuous pattern of a conventional technique. Moreover, in another embodiment, the strip film layer 600 has a strip grain or a strip color. Each of the two cover panels adjacent to each other has a panel grain or a panel color. The strip grain is communicated with the panel grain, or the strip color is communicated with the panel color. Accordingly, the ball structure 100 of the present disclosure utilizes the continuous pattern, the continuous grain or the continuous color on the cover strip 400*e* and each of the cover panels 300 to enhance integrity and consistency of the ball structure 100.

Figure 9:
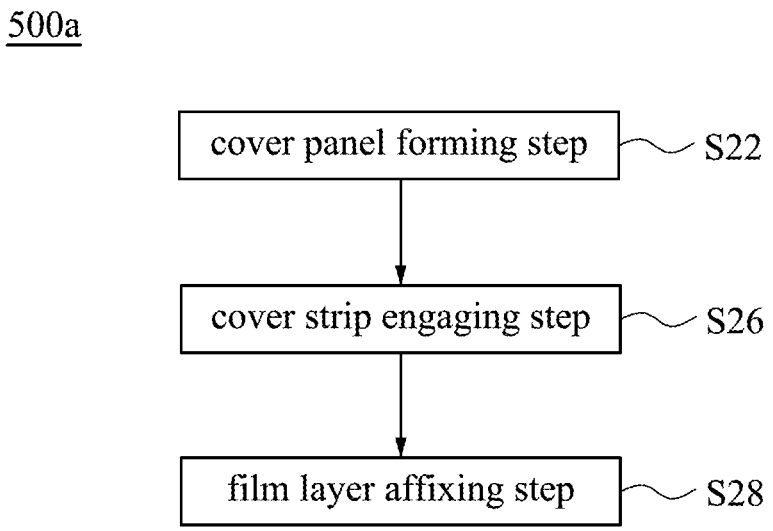
FIG. 9 shows a flow chart of a manufacturing method of a ball structure according to further another embodiment of the present disclosure.

FIG. 9 shows a flow chart of a manufacturing method 500*a* of a ball structure 100 according to further another embodiment of the present disclosure. The ball structure 100 is shown in FIG. 8. The manufacturing method 500*a* of the ball structure 100 provides a cover panel forming step S22, a cover strip engaging step S26 and a film layer adhering step S28.

In FIG. 9, the detail of the cover panel forming step S22 and the cover strip engaging step S26 is the same as the cover panel forming step S12 and the cover strip engaging step S16 of FIG. 7, respectively, and will not be described again herein. The manufacturing method 500*a* of the ball structure 100 further provides the film layer adhering step S28 for thermally adhering the strip film layer 600 to the first layer 410*e* of the cover strip 400*e*. The strip pattern 610 of the strip film layer 600 is communicated with the panel pattern 322 of the panel film layer 320. Therefore, the manufacturing method 500*a* of the ball structure 100 of the present disclosure can produce the cover strip 400*e* having a precise size and allow the panel pattern 322 and the strip pattern 610 to communicate with each other, thereby forming the continuous pattern on the cover strip 400*e* and each of the cover panels 300.

Figure 10:
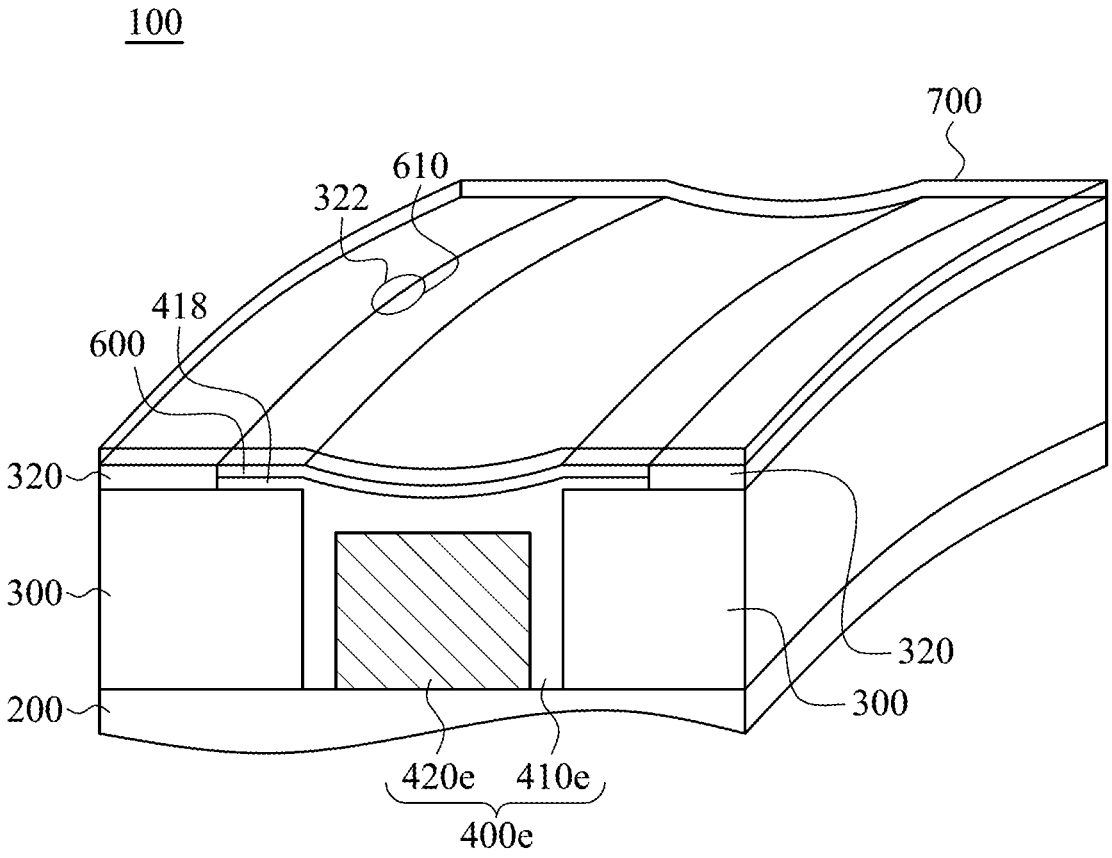
FIG. 10 shows a schematic view of a ball structure according to a seventh embodiment of the present disclosure.

FIG. 10 shows a schematic view of a ball structure 100 according to a seventh embodiment of the present disclosure. The ball structure 100 includes an inner layer 200, a plurality of cover panels 300, a plurality of panel film layer 320, a cover strip 400*e*, a strip film layer 600 and a protective layer 700.

In FIG. 10, the structures of the inner layer 200, the cover panels 300, the panel film layer 320, the cover strip 400*e* and the strip film layer 600 are the same as the structures of the inner layer 200, the cover panels 300, the panel film layer 320, the cover strip 400*e* and the strip film layer 600 of FIG. 8 and will not be described again herein. The ball structure 100 further includes the protective layer 700 covered outside the cover panels 300 and the cover strip 400*e*. The protective layer 700 is transparent. In other words, the protective layer 700 is covered outside the strip film layer 600 and the panel film layer 320, so that the strip film layer 600 and the panel film layer 320 are not affected by the external environment.

Figure 11:
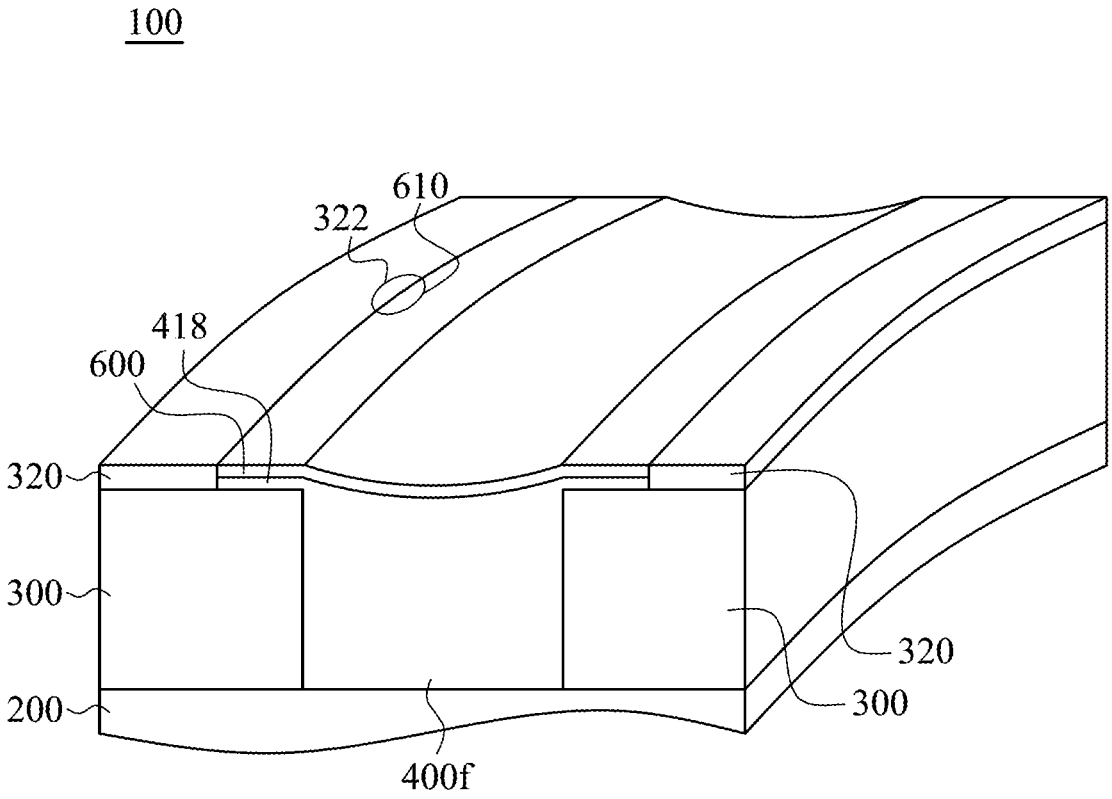
FIG. 11 shows a schematic view of a ball structure according to an eighth embodiment of the present disclosure.

FIG. 11 shows a schematic view of a ball structure 100 according to an eighth embodiment of the present disclosure. The ball structure 100 includes an inner layer 200, a plurality of cover panels 300, a plurality of panel film layer 320, a cover strip 400*f* and a strip film layer 600.

In FIG. 11, the structures of the inner layer 200, the cover panels 300, the panel film layer 320 and the strip film layer 600 are the same as the structures of the inner layer 200, the cover panels 300, the panel film layer 320 and the strip film layer 600 of FIG. 8 and will not be described again herein. The ball structure 100 further includes the cover strip 400*f* having a single hardness and a single-layered structure. Accordingly, the ball structure 100 of the present disclosure utilizes the cover strip 400*f* engaged with the inner layer 200 and the cover panels 300 to achieve the supporting effect.

Figure 12:
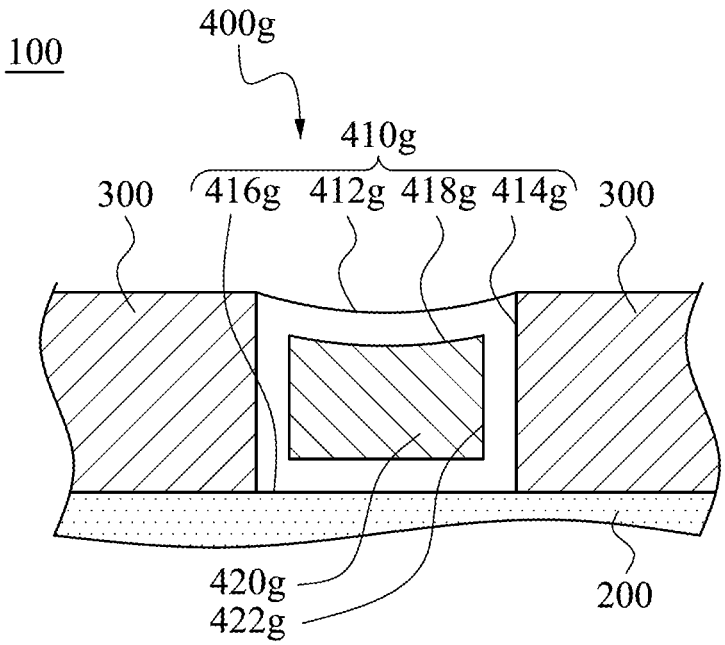
FIG. 12 shows a schematic view of a ball structure according to a ninth embodiment of the present disclosure.

FIG. 12 shows a schematic view of a ball structure 100 according to a ninth embodiment of the present disclosure. The ball structure 100 includes an inner layer 200, a plurality of cover panels 300 and a cover strip 400*g*.

In FIG. 12, the structures of the inner layer 200 and the cover panels 300 are the same as the structures of the inner layer 200 and the cover panels 300 of FIG. 3A and will not be described again herein. The ball structure 100 further includes the cover strip 400*g*. The cover strip 400*g* includes a first layer 410*g* and a second layer 420*g*. The first layer 410*g* has a hollow shape. The first layer 410*g* includes an outer surface 412*g*, two side surfaces 414*g*, and an inner surface 416*g* and an inner ring surface 418*g*. The two side surfaces 414*g* are connected to the two cover panels 300 adjacent to each other, respectively. The inner surface 416*g* is corresponding to the outer surface 412*g* and is connected to the inner layer 200. The second layer 420*g* is surrounded by the inner ring surface 418*g*. The second layer 420*g* includes an outer ring surface 422*g* which is connected to the inner ring surface 418*g*. Therefore, the ball structure 100 of the present disclosure utilizes the cover strip 400*g* engaged with the inner layer 200 and the cover panels 300 to achieve the supporting effect.

According to the aforementioned embodiments and examples, the advantages of the present disclosure are described as follows.

1. The ball structure of the present disclosure utilizes the cover strip having a single hardness, a soft inner layer combined with a hard outer layer or a hard inner layer combined with a soft outer layer to be capable of achieving the supporting effect.

2. No mater whether the structure of the soft inner layer combined with the hard outer layer or the hard inner layer combined with the soft outer layer is manufactured by the same or different materials, the cover strip may be capable of achieving the supporting effect.

3. In the ball structure of the present disclosure, the strip pattern may be communicated with the panel pattern. The strip grain may be communicated with the panel grain. The strip color may be communicated with the panel color. After injecting the gas into the ball structure to expand the inner layer, the cover strip is thermally engaged in the groove to form a continuous pattern, the continuous grain or the continuous color on the cover strip and each of the cover panels so as to solve a problem of a discontinuous pattern of a conventional technique and to enhance integrity and consistency of the ball structure.

4. The protective layer of the present disclosure can be covered outside the cover panels and the cover strip, so that the strip film layer and the panel film layer are not affected by the external environment.

5. The ball structure of the present disclosure utilizes the cover strip having different hardness in an inner-outer direction or an up-down direction to be capable of increasing the combinations of the cover panels and the cover strip.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A ball structure, comprising:

an inner layer;

at least two cover panels disposed on the inner layer, each defining an inner surface and an outer surface, wherein a groove is formed among the two cover panels adjacent to each other and the inner layer;

a cover strip engaged in the groove, wherein the cover strip comprises a first layer and a second layer, the first layer is connected to the second layer, a hardness of the first layer is different from a hardness of the second layer, and the first layer is connected between the two cover panels adjacent to each other; and a strip film layer adhered to the first layer, wherein the strip film layer has a strip grain, a strip pattern or a strip color, each of the two cover panels adjacent to each other has a panel grain, a panel pattern or a panel color, wherein the strip grain is communicated with the panel grain, the strip pattern is communicated with the panel pattern, or the strip color is communicated with the panel color, wherein the first layer comprises two convex portions, and the two convex portions cover part of the two outer surfaces of the two cover panels adjacent to each other, respectively.

2. The ball structure of claim 1, wherein, the first layer comprises:

a first outer surface;

two side surfaces connected to the two cover panels adjacent to each other, respectively; and a first inner surface connected to the second layer and opposite to the first outer surface; and the second layer comprises:

a second outer surface connected to the first inner surface; and a second inner surface connected to the inner layer and the second outer surface.

3. The ball structure of claim 1, further comprising:

a protective layer covered outside the two cover panels and the cover strip, wherein the protective layer is transparent.

4. A manufacturing method of a ball structure, comprising:

providing a cover panel forming step, wherein the cover panel forming step is for affixing at least two cover panels on an inner layer to form a groove among the inner layer and the two cover panels adjacent to each other; and providing a cover strip engaging step, wherein the cover strip engaging step is for injecting a gas into the ball structure to expand the inner layer so as to increase a width of the groove, engaging a cover strip in the groove, and then discharging the gas from the ball structure to shrink the inner layer so as to decrease the width of the groove and tightly connect the cover strip to the two cover panels.

* * * * *